United States Patent [19]

Winburn et al.

[11] 4,357,741

[45] Nov. 9, 1982

[54] REMOVABLE PANEL FOR A CASKET LID

[75] Inventors: Charles F. Winburn, Batesville, Ind.; William K. Craft; Gregory T. Keferl, both of Cincinnati, Ohio; Wilfred Scheele, Batesville; Juanita Baker, Metamora, both of Ind.

[73] Assignee: Batesville Casket Company, Inc., Batesville, Ind.

[21] Appl. No.: 254,085

[22] Filed: Apr. 14, 1981

[51] Int. Cl.[3] ..... A61G 17/00

[52] U.S. Cl. ..... 27/19

[58] Field of Search ..... 27/19, 14, 15, 16, 2, 27/1

[56] References Cited

U.S. PATENT DOCUMENTS

| | | | |
|---|---|---|---|
| 1,931,828 | 10/1933 | Overstreet | 27/19 |
| 2,044,967 | 6/1936 | Bowler, Jr. | 27/19 |
| 2,947,059 | 8/1960 | Hillenbrand | 27/19 |
| 3,157,936 | 11/1964 | Hillenbrand | 27/19 |
| 3,228,085 | 1/1966 | Nelson | 27/19 |

*Primary Examiner*—John D. Yasko

*Attorney, Agent, or Firm*—Burns, Doane, Swecker & Mathis

[57] ABSTRACT

A decorative lining for a casket lid comprises a panel bordered along at least two edges by framing, and a fastening arrangement for securing the panel to the lid. The fastening arrangement includes a first tab secured to the panel and projecting beyond one edge thereof. The first tab is insertable behind a first portion of the framing located adjacent such one edge. A second tab is secured to the panel by a first attaching device and projects beyond an opposite edge of the panel. The second tab is insertable behind a second portion of the framing located adjacent such opposite edge. A second attaching device is disposed intermediate the first attaching device and such opposite edge for securing the panel to the second tab in response to inward pressing of the panel towards the second tab.

22 Claims, 8 Drawing Figures

REMOVABLE PANEL FOR A CASKET LID

BACKGROUND AND OBJECTS OF THE INVENTION

The present invention relates to decorative linings for casket lids and, in particular, to quickly removable decorative panels.

Caskets have traditionally been provided with decorative upholstery which covers the interior of the lid and container portions of the casket. Upholstery for the lid has traditionally comprised a central panel surrounded by a framing, commonly referred to as "puffing". The upholstery is available in a variety of colors and patterns.

It is desirable for a mortician to make available a wide selection of aesthetic combinations. For this reason, it has been proposed to provide easily removable panels which are retained in place by quick-release fasteners, to enable panels of different color and/or pattern to be interchanged. One proposed quick-release is disclosed for example in U.S. Pat. No. 1,931,828 issued to Overstreet on Oct. 24, 1933. In that arrangement, fasteners (e.g., snaps) are mounted to the casket lid, and cooperative fasteners are mounted on interchangeable panels. By pressing a panel against the lid interior, the fasteners engage. Problems associated with arrangements of that type involve not only the difficulty in attaching a fastener to the casket lid, but also the need to properly align the fasteners for interconnection.

It is, therefore, an object of the present invention to provide a novel upholstery arrangement for a casket lid.

Another object of the invention is to provide an arrangement of interchangeable decorative panels for a casket lid.

It is a further object of the invention to provide a novel quick-release means for interchanging decorative panels.

An additional object of the invention is to provide such a quick-release which does not involve a permanent attachment of a fastener to the casket lid and assures alignment between the cooperating fastener components.

SUMMARY OF THE INVENTION

These and other objects are achieved by the present invention which involves a decorative lining for a casket lid. The lining comprises a panel bordered along at least two edges by framing, a fastening arrangement for securing the panel to the lid. The fastening arrangement includes a first tab secured to the panel and projecting beyond one edge thereof. The first tab is insertable behind a first portion of the framing located adjacent such one edge. A second tab is secured to the panel by a first attaching device and projects beyond an opposite edge of the panel. The second tab is insertable behind a second portion of the framing located adjacent such opposite edge. A second attaching device is disposed intermediate the first attaching device and such opposite edge for securing the panel to the second tab in response to inward pressing of the panel toward the second tab.

THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 1:
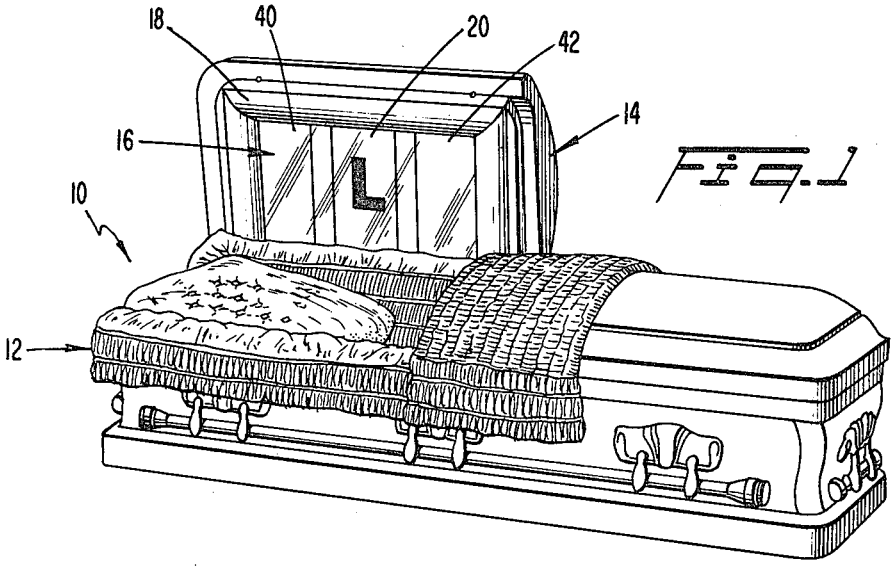
FIG. 1 is a perspective view of a casket and lining according to the present invention.

In accordance with the present invention, a casket 10 is depicted in FIG. 1 comprising a container 12 and a lid 14 hingedly mounted thereon. The container has installed therein the customary decorative upholstery and the lid contains the customary lining in the form of a central panel 16 and framing 18 in the form of puffing which borders the panel 16 on all sides. The puffing and panel can be of various colors and pattern, it being customary for a mortician to stock a variety of each.

Figure 2:
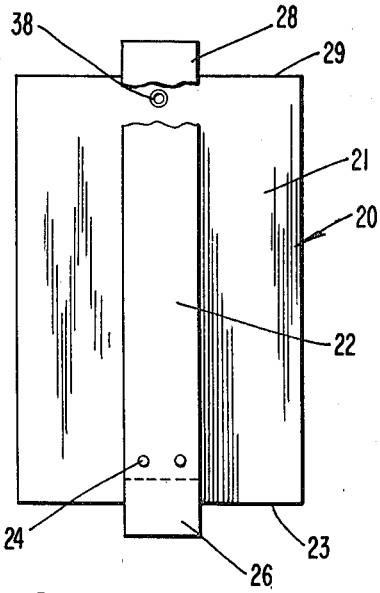
FIG. 2 is a rear view of a panel member according to the present invention with a portion of a strap removed to expose a snap fastener on the back of the panel member.
Figure 3:
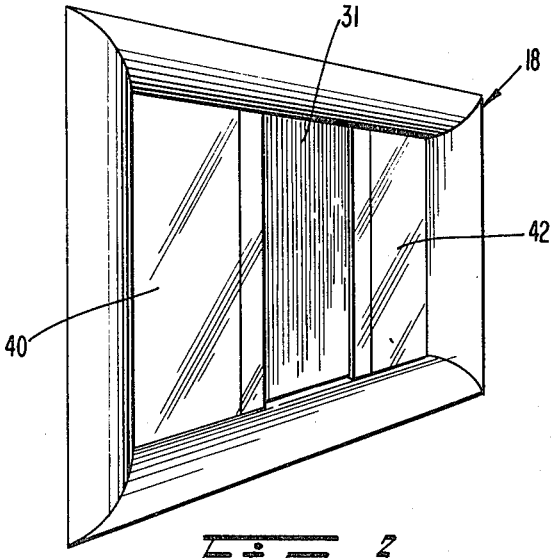
FIG. 3 is a perspective view of the lining prior to insertion of a panel member.

In accordance with the present invention, panel members of different color and/or pattern are conveniently interchangeably mountable on the casket lid to enable a wide variety of decorative effects to be provided. In FIG. 1, the panel member comprises a section 20 of the panel which is provided with a symbol, emblem, etc., having special significance to the deceased. The panel member 20 is releasably securable to the casket lid by an easily manipulable fastening arrangement which comprises one or more straps 22 (FIG. 2) permanently mounted to the backside 21 of the panel member near a lower edge 23 thereof, such as by rivets 24 for example. The bottom end 26 of the strap projects beyond that lower edge to form a lower tab. The upper end 28 of the strap projects beyond an upper edge 29 of the panel member 20 to form an upper tab.

Figure 4:
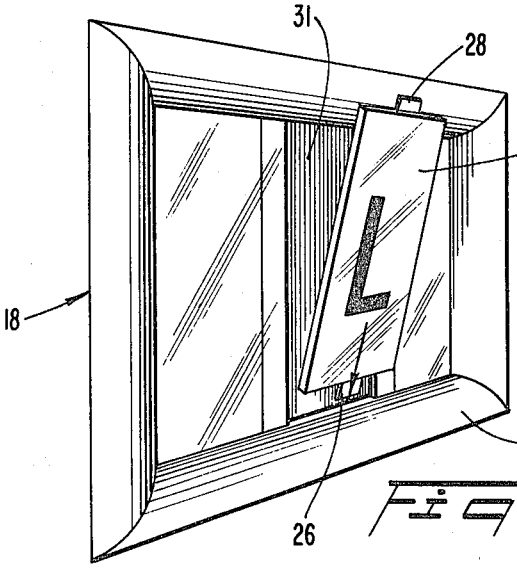
FIG. 4 is a perspective view of an initial step in the insertion of the panel member.
Figure 5:
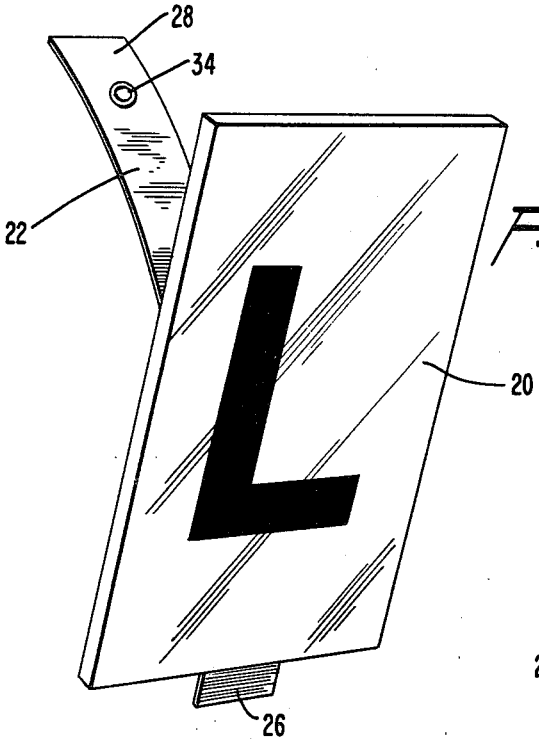
FIG. 5 is a perspective view of the panel member.
Figure 6:
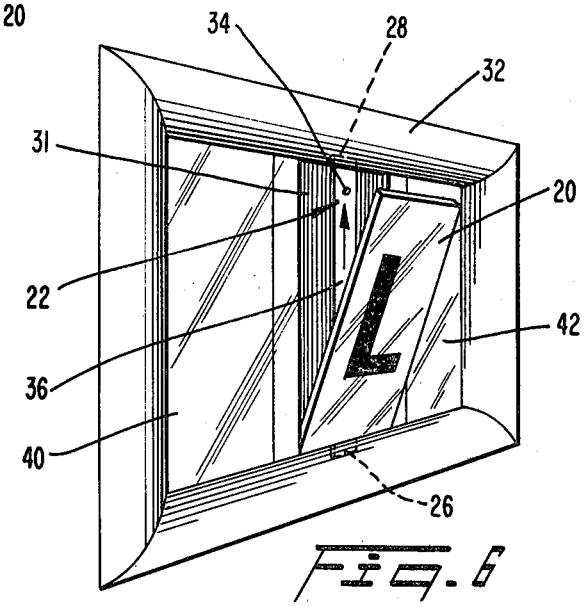
FIG. 6 is a perspective view of a second step in the insertion of the panel member.
Figure 7:
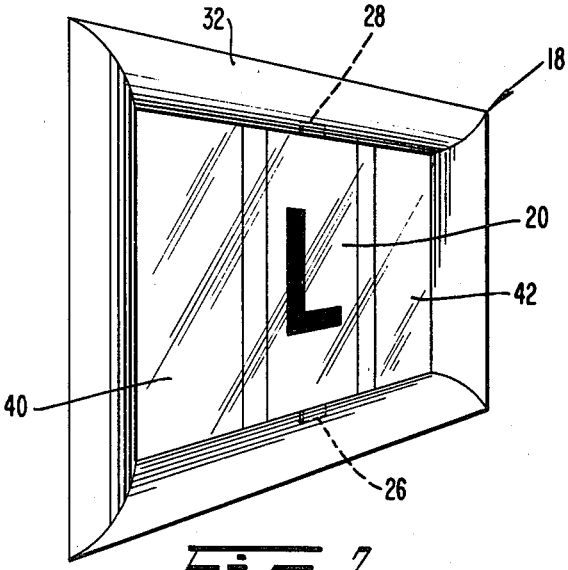
FIG. 7 is a perspective view of the lining with the panel member in place.
Figure 8:
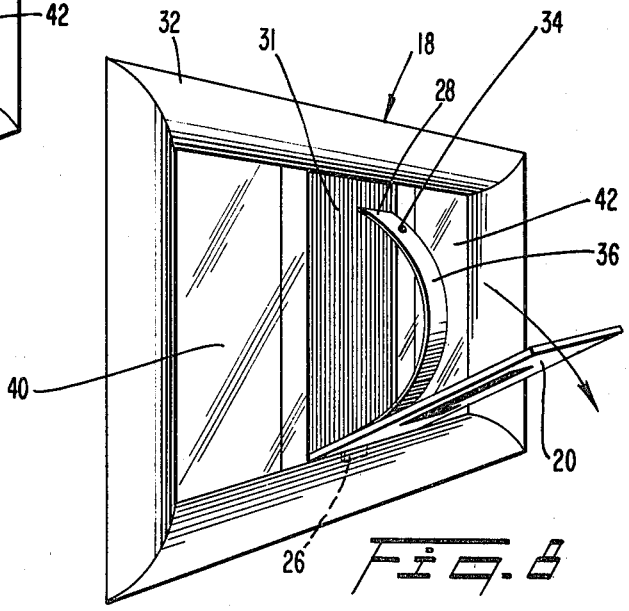
FIG. 8 is a perspective view of the lining depicting the step of removing the panel member.

The lower tab 26 may be slipped downwardly behind a lower portion 30 of the puffing and in front of a wall 31 of the casket lid as depicted in FIG. 4. With the panel member angled outwardly from the lid, the upper tab 28 can be slipped upwardly behind an upper portion 32 of the puffing as depicted in FIG. 6.

In order to thereafter securely locate the panel member 20, there is provided an attachment between the panel member 20 and the strap 22 intermediate the upper and lower panel edges 29, 23. One preferred attachment comprises a snap fastener wherein one of the cooperative male and female parts 34, 38 is carried by a front face 36 of the strap and the other part 38 is carried by the back wall 21 of the panel member. When the panel is pressed inwardly, the snap parts 34, 38 engage one another to retain the panel member 20. Retainment of the panel is aided by a snug-fit between the adjacent portions 40, 42 of the panel and the upper and lower puffing portions 32, 30.

Figure 11:
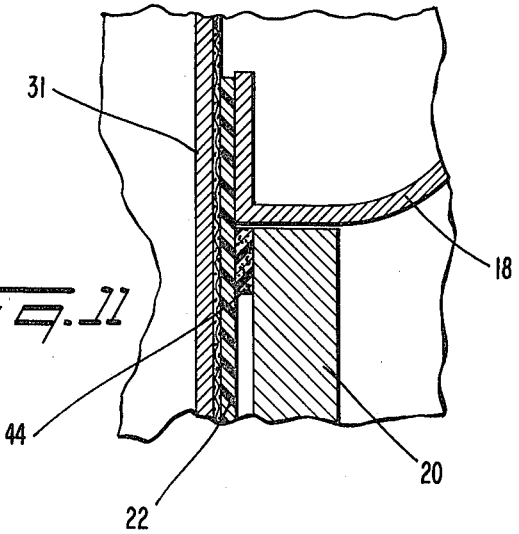
FIG. 11 is a cross-sectional view through the lining with the panel member installed.
Figure 12:
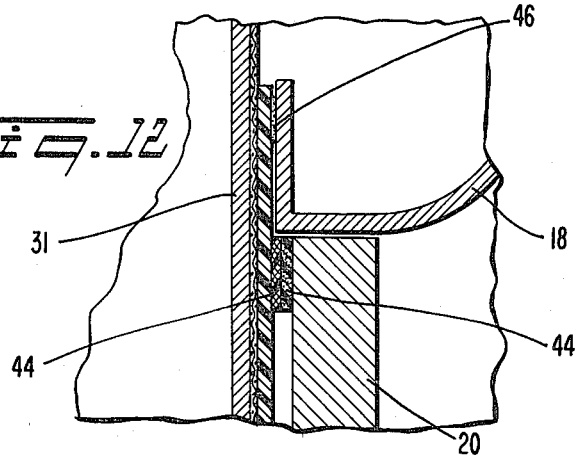
FIG. 12 is a cross-sectional view similar to FIG. 11 depicting an alternate fastener expedient.

In lieu of snap fastener 34, 38, there can be employed a piece of foam adhesive 44 (FIG. 11) mounted on either the strap or the panel back wall (FIG. 11), or on both (FIG. 12). The adhesive is provided with a removable backing strip which is only removed when the panel is to be installed permanently. Other types of attachments, such as Velcro strips (not shown) can be employed in lieu of snap fasteners and foamed adhesive.

The strap 22 and panel member 20 may be formed of any suitable material which is of sufficient stiffness to retain its shape, such as cardboard for example.

Attachment of the strap 22 to the panel member 20 by means of the rivets 24 is performed while the snap fastener 34, 38 is engaged, thus assuring that the snap fastener components 34, 38 will thereafter be permanently aligned with one another.

It may be desirable to provide an attachment member on one or both of the upper and lower tabs, preferably the upper tab 28, to secure same to the puffing 18. This can be achieved by providing a foam adhesive 46 (FIG. 12) on the front face of the upper tab 28 and arranged to seat behind the puffing and adhere thereto when the backing is removed from the adhesive. Such an attachment can be used in lieu of or in addition to the second attachment 34, 38 (or 44).

Figure 9:
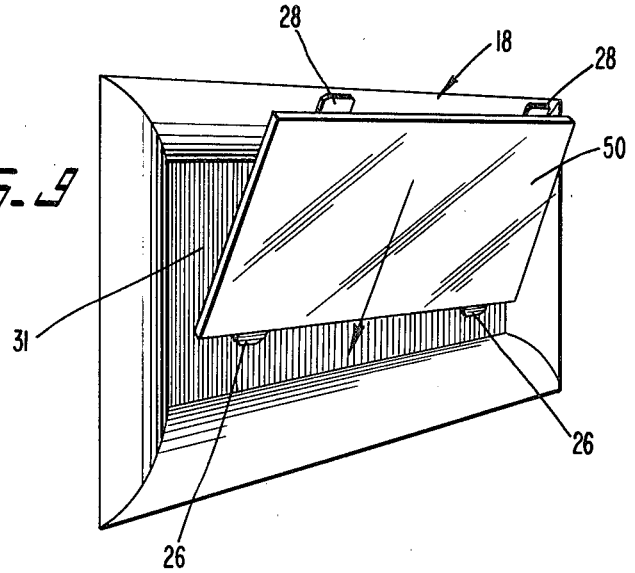
FIG. 9 is a perspective view of a first step of installing another type of panel member.
Figure 10:
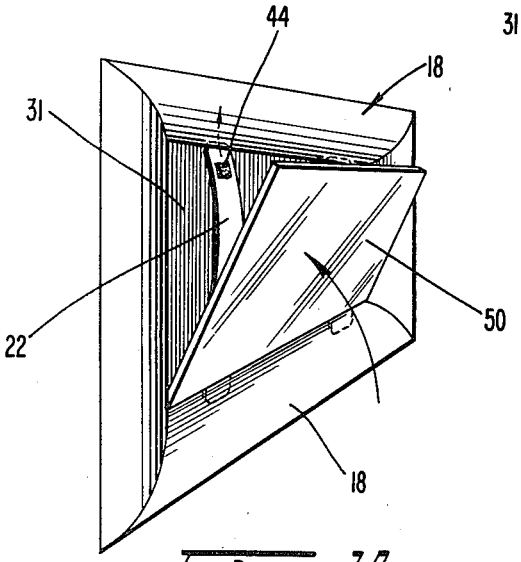
FIG. 10 is a perspective view of a second step in the insertion of the panel member of FIG. 9.

Instead of providing the removable panel member as a section of the panel, it may be desirable to provide the entire panel as the replaceable member. Thus, as depicted in FIGS. 9–10, the entire panel member 50 is removable and is provided with a pair of straps 22. Installation and removal of the panel member is achieved in the same manner as described in connection with the embodiment of FIG. 1.

It will be appreciated that the present invention provides a conveniently removable panel member which does not require the installation of a fastener directly to the lid of the casket. Rather, all of the fasteners are carried by the panel-strap assembly. Moreover, proper alignment between the fasteners is permanently established at the time of assembly of the strap and panel member.

Although depicted in connection with a casket lid having relatively movable head and foot portions, the present invention is applicable to one-piece casket lids.

Although the invention has been described in connection with a preferred embodiment thereof, it will be appreciated by those skilled in the art that additions, modifications, substitutions and deletions may be made without departing from the spirit and scope of the invention as defined in the appended claims.

What is claimed is:

1. A decorative lining for a casket lid, the lining comprising:

panel means bordered along at least two edges by framing means, and fastening means for securing said panel means to said lid comprising:

a first tab secured to said panel means and projecting beyond one edge thereof, said first tab being insertable behind a first portion of said framing means located adjacent said one edge, and a second tab secured to said panel by first attaching means and projecting beyond an opposite edge of said panel means, said second tab being insertable behind a second portion of said framing means located adjacent said opposite edge, and second attaching means disposed intermediate said first attaching means and said opposite edge for securing said panel means to said second tab in response to inward pressing of said panel means toward said second tab.

2. A decorative lining according to claim 1, wherein said panel means comprises an entire panel bordered along four sides by said framing.

3. A decorative lining according to claim 1, wherein said panel means comprises a section of a panel.

4. A decorative lining according to claim 1, wherein said fastening means comprises a strap attached to said panel means by said first attaching means adjacent said one edge of said panel means, said first and second tabs defined by opposite ends of said strap.

5. A decorative lining according to claim 4, wherein said one edge comprises a lower edge of said panel means and said opposite edge comprises an upper edge of said panel means.

6. A decorative lining according to claim 5, wherein said second attaching means comprises cooperative attaching means mounted on a front face of said strap and a back wall of said panel means.

7. A decorative lining according to claim 5, wherein said cooperative attaching means comprises a snap fastener.

8. A decorative lining according to claim 5, wherein said cooperative attaching means comprises adhesive strips each having selectively removable backing.

9. A decorative lining according to claim 1 including third attaching means mounted on a front face of said second tab and arranged to adhere to said second overlay portion when slipped therebehind.

10. A decorative lining according to claim 9, wherein said third attaching means comprises an adhesive member mounted on a front face of said second tab and having a selectively removable backing.

11. A decorative lining according to claim 1, wherein there are a plurality of said fastening means.

12. A decorative lining for a casket lid, the lining comprising:

panel means bordered along at least upper and lower edges thereof by a framing, and fastening means for securing said panel means to said lid comprising:

a strap secured to a back wall of said panel means by first attaching means such that a lower end of said strap projects beyond a lower edge of said panel means and an upper end of said strap projects beyond a lower edge of said panel means, said lower strap end being insertable downwardly behind a lower portion of said framing, said upper strap end being insertable upwardly behind an upper portion of said framing, and second attaching means disposed above said first attaching means for securing a back wall of said panel means to a front face of said strap in response to inward pressing of said panel means against said strap.

13. A decorative lining according to claim 12, wherein said panel means comprises an entire panel bordered along four sides of said framing.

14. A decorative lining according to claim 12, wherein said panel means comprises a section of a panel.

15. A decorative lining according to claim 12, wherein said strap is attached to said back wall of said panel means adjacent said lower edge thereof.

16. A decorative lining according to claim 12, wherein said second attaching means includes cooperative attaching means mounted on said strap and said panel means.

17. A decorative lining according to claim 16, wherein said cooperative attaching means comprises a snap fastener.

18. A decorative lining according to claim 16, wherein said cooperative fastening means comprises an adhesive having a selectively removable backing.

19. A decorative lining according to claim 12, including third attaching means on a front face of said upper portion of said strap above said upper edge of said panel means and arranged to adhere to a back wall of said framing when inserted therebehind.

20. A decorative lining according to claim 12, wherein there are a plurality of said fastening means.

21. A decorative lining for a casket lid, the lining comprising:

panel means bordered along at least two edges by a framing, and fastening means for securing said panel means to said lid comprising:

a first tab secured to said panel means and projecting beyond one edge thereof, said first tab being insertable behind a first portion of said framing means located adjacent said one edge, and a second tab secured to said panel by first attaching means and projecting beyond an opposite edge of said panel means, said second tab being insertable behind a second portion of said framing means located adjacent said opposite edge, and additional attachment means mounted on a portion of said second tab projecting beyond said opposite edge, said additional attaching means being arranged to adhere to said second portion of said framing when inserted therebehind.

22. A decorative panel insertable in a casket lid to be bordered by a framing, said panel comprising:

a panel member, fastening means secured to said panel member by a first attaching means for insertion behind the framing on the casket lid for releasably securing said fastening means to said casket lid, said panel member being movable relative to said fastening means to facilitate insertion of the latter behind the framing, and second attaching means spaced from said first attaching means for securing said panel member to said fastening means following insertion of the latter behind said framing, to prevent movement of said panel member relative to said fastening means.

* * * * *